US009028020B2

(12) United States Patent
Gossens et al.

(10) Patent No.: US 9,028,020 B2
(45) Date of Patent: May 12, 2015

(54) STABILIZING PANEL

(75) Inventors: Caleb Gossens, Anderson, SC (US); Nicolas Saeger, Anderson, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 114 days.

(21) Appl. No.: 13/045,652

(22) Filed: Mar. 11, 2011

(65) Prior Publication Data

US 2012/0228252 A1 Sep. 13, 2012

(51) Int. Cl.

*A47B 96/04* (2006.01)
*A47B 73/00* (2006.01)
*A47B 96/02* (2006.01)

(52) U.S. Cl.

CPC ..... *A47B 73/00* (2013.01); *A47B 96/02* (2013.01); *F25D 2331/805* (2013.01)

(58) Field of Classification Search

CPC ... A47B 73/00; A47B 96/02; F25D 2331/805
USPC ..... 312/405.1, 408, 351, 116, 126; 108/108, 90, 55.3, 55.1, 57.16; 211/59.2, 85.4, 134, 59.4, 183, 74, 211/135; D9/756, 761, 751, 456, 758, 757; 428/158, 159, 179, 156, 178, 180; 206/160, 427; 248/912, 346.02, 310, 248/671, 678, 634, 633; 62/377, 382

See application file for complete search history.

(56) References Cited

U.S. PATENT DOCUMENTS

D172,596 S 7/1954 Harper
2,808,189 A * 10/1957 Williams ..... 206/592
3,086,899 A * 4/1963 Ingraham et al. ..... 428/158
3,040,923 A 6/1963 Leitzel
3,108,924 A * 10/1963 Adie ..... 428/158
3,642,566 A * 2/1972 Figge ..... 428/180
3,708,084 A * 1/1973 Bixler et al. ..... 217/26.5
3,843,009 A 10/1974 Emery
3,899,805 A * 8/1975 McMillan ..... 24/584.1
4,262,048 A * 4/1981 Mitchell ..... 428/99
D281,955 S * 12/1985 Moller ..... D9/758
4,567,981 A * 2/1986 Headon ..... 206/597
D308,822 S * 6/1990 Congleton ..... D9/757
4,942,965 A * 7/1990 Comer ..... 206/419
D327,841 S 7/1992 Letourneau
5,201,101 A * 4/1993 Rouser et al. ..... 24/586.11
5,455,100 A * 10/1995 White ..... 428/131
5,488,981 A * 2/1996 Burkhart ..... 150/166

(Continued)

OTHER PUBLICATIONS

Mode Studio. Fridge Monkey. http://www.modestudio.co.uk/products-mode-fridge-monkey.php?g=fridge-monkey, Feb. 3, 2009.

*Primary Examiner* — Daniel J Troy
*Assistant Examiner* — Hiwot Tefera
(74) *Attorney, Agent, or Firm* — Pearne & Gordon LLP

(57) ABSTRACT

A stabilizing panel for placing items thereon is provided with a first surface including a plurality of parallelogram areas including four corners and four sides. Each corner of the parallelogram areas includes a peak, and the peaks are aligned so as to be parallel with one of the four sides of the parallelogram areas on the first surface. Each of the parallelogram areas defines a depression. The stabilizing panel may be rectangular and includes a pair of adjacent first edges and a pair of adjacent second edges. Each first edge is configured with a male connecting section and each second edge is configured with a female connecting section configured to interlock with the male connecting section of a neighboring stabilizing panel.

22 Claims, 10 Drawing Sheets

(56) References Cited

U.S. PATENT DOCUMENTS

| | | | | |
|---|---|---|---|---|
| 5,609,942 | A * | 3/1997 | Ray | 428/182 |
| 5,666,777 | A * | 9/1997 | Murphy | 52/604 |
| D396,408 | S | 7/1998 | Carver | |
| 6,478,292 | B1 * | 11/2002 | Sellers | 269/289 R |
| 6,692,693 | B2 * | 2/2004 | Wu | 422/22 |
| 6,820,743 | B2 * | 11/2004 | Hurley et al. | 206/427 |
| 6,932,449 | B2 * | 8/2005 | Collins et al. | 312/405.1 |
| D518,720 | S * | 4/2006 | Gratz | D9/456 |
| 7,044,358 | B2 * | 5/2006 | Gratz | 229/100 |
| 7,117,994 | B2 * | 10/2006 | Gratz | 206/446 |
| 7,121,408 | B2 * | 10/2006 | Wilson | 206/433 |
| D535,881 | S * | 1/2007 | Liukko | D9/456 |
| 7,267,700 | B2 * | 9/2007 | Collins et al. | 51/298 |
| D655,608 | S * | 3/2012 | Taljaard et al. | D9/456 |
| 2002/0114918 | A1 * | 8/2002 | Mossbeck et al. | 428/90 |
| 2002/0187077 | A1 * | 12/2002 | Berray et al. | 422/99 |
| 2003/0203155 | A1 * | 10/2003 | Kobe et al. | 428/119 |
| 2004/0001784 | A1 | 1/2004 | Sullivan et al. | |
| 2004/0031711 | A1 * | 2/2004 | O'Malley | 206/427 |
| 2005/0045648 | A1 * | 3/2005 | Mayrose | 220/737 |
| 2005/0115473 | A1 * | 6/2005 | Schutz | 108/55.1 |
| 2006/0255704 | A1 * | 11/2006 | Grobleben et al. | 312/408 |
| 2006/0292343 | A1 * | 12/2006 | Sellers | 428/131 |
| 2007/0228909 | A1 * | 10/2007 | Hwang et al. | 312/408 |
| 2011/0159230 | A1 * | 6/2011 | Goode | 428/92 |
| 2012/0061273 | A1 * | 3/2012 | Taljaard et al. | 206/427 |

* cited by examiner

STABILIZING PANEL

FIELD OF THE INVENTION

The present invention relates generally to panels on top of which items can be placed, and more particularly, to panels for stabilizing bottles, cans or the like.

BACKGROUND OF THE INVENTION

The arrangement of shelves inside a cabinet structure such as a refrigerator is such that certain shelves accommodate taller item or items that must be kept upright while other shelves provide space for shorter items or items that can be laid down. Beverages such as bottles and cans can be stored inside a refrigerator by placing them on shelves provided in the compartment or shelves provided on the inside of the door. However, when these spaces are not available, the shelves may not be sufficient to accommodate these items in upright positions and simply laying down the beverage items may not be an alternative because such items are often have round surfaces and may become unstable and roll on the storage surface. Thus, there is a need to enable the usage of the height-restricted spaces at a storage area while stabilizing bottles, cans or other round items when they are laid down.

BRIEF SUMMARY OF THE INVENTION

In one example aspect, a stabilizing panel for placing items thereon includes a first surface including a plurality of parallelogram areas which includes four corners and four sides. Each corner of the parallelogram areas includes a peak. The peaks are aligned so as to be parallel with one of the four sides of the parallelogram areas on the first surface. Each of the parallelogram areas defines a depression.

In another example aspect, a center of each of the parallelogram areas is at the first elevation, the peaks are at a second elevation, and the second elevation is greater than the first elevation.

In yet another example aspect, the depression is shaped such that first surface gradually transitions from the first elevation to the second elevation.

In yet another example aspect, the depression includes concave surfaces such that the depression has a first radius of curvature about a first axis and a second radius of curvature about a second axis, the first axis and the second axis intersecting one another.

In yet another example aspect, the four sides of parallelogram areas include a first set of parallel sides and a second set of parallel sides, and the first axis is parallel to the first set of parallel sides and the second axis is parallel to the second set of parallel sides.

In yet another example aspect, the first radius of curvature and the second radius of curvature are the same.

In yet another example aspect, the peak is a tip of a substantially cone-shaped protrusion.

In yet another example aspect, the peak is a tip of a substantially pyramid-shaped protrusion.

In yet another example aspect, the entire first surface is divisible into a plurality of complete parallelogram areas.

In yet another example aspect, each parallelogram area is arranged such that at least one of the four sides of one of the parallelogram areas is bounded by one of the four sides of another of the parallelogram areas.

In yet another example aspect, all of the parallelogram areas include only one depression and are equal in size.

In yet another example aspect, the stabilizing panel is made of elastomer.

In yet another example aspect, the first surface is slip resistant.

In yet another example aspect, the stabilizing panel includes a second surface that is opposite the first surface and is flat.

In yet another example aspect, the stabilizing panel is rectangular and each corner of the stabilizing panel includes a peak, and at least a peak, other than the peaks at the corners, is arranged along each edge of the stabilizing panel.

In yet another example aspect, the stabilizing panel is configured as a mat.

In yet another example aspect, the stabilizing panel is configured as a shelf.

In yet another example aspect, the parallelogram areas are squared areas.

In yet another example aspect, a stabilizing panel for stabilizing items placed thereon includes a first surface including a plurality of parallelogram areas. Each parallelogram area includes a substantially diamond configuration defined by four triangular surfaces meeting at a peak.

In yet another example aspect, the triangular surfaces are concave and have equal radii of curvature.

In yet another example aspect, the peaks are aligned transversely and longitudinally in an orthogonal grid pattern on the first surface.

In yet another example aspect, the stabilizing panel is rectangular and each corner of the stabilizing panel includes a peak, and each edge of the stabilizing panel includes a peak.

In yet another example aspect, a parallelogram stabilizing panel for placing items thereon includes a pair of adjacent first edges and a pair of adjacent second edges. Each first edge is configured with a male connecting section. Each second edge is configured with a female connecting section configured to interlock with the male connecting section of a neighboring stabilizing panel.

In yet another example aspect, the male connecting section extends substantially along each first edge, and the female connecting section extends substantially along each second edge.

In yet another example aspect, each of the male connecting sections and the female connecting sections includes a tongue portion and a groove portion configured to accommodate the tongue portion of the neighboring stabilizing panel.

In yet another example aspect, the stabilizing panel includes a two-layer periphery with a top layer and a bottom layer offset in an angled direction from one another such that edges of the top layer are offset from neighboring edges of the bottom layer.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
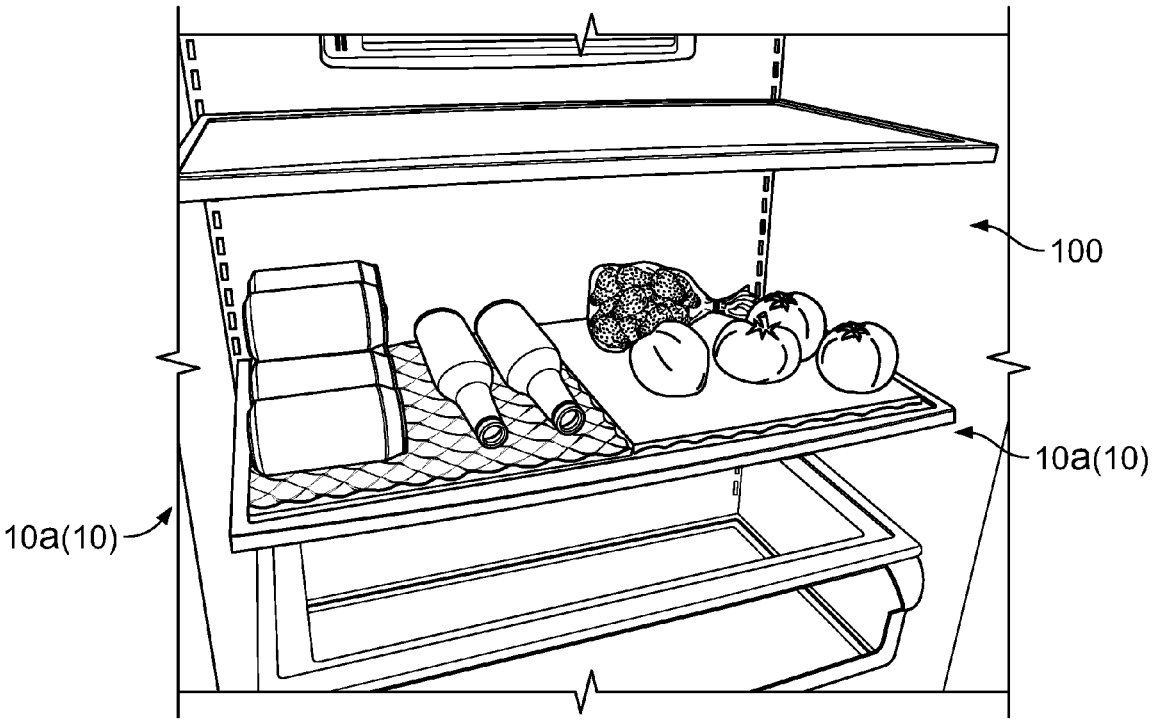
FIG. 1 is a view of a first example embodiment of a stabilizing panel in accordance with the present invention inside a cabinet structure.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

FIG. 1 shows one embodiment of a stabilizing panel 10 in accordance with the present invention. The stabilizing panel 10 may be a structure that provides a substantially planar surface that can stabilize items placed thereon. The stabilizing panel 10 may be embodied as a flexible or pliable object such as a mat 10*a* (FIG. 1) which can be laid down on a surface but needs an underlying foundation to form the substantially planar surface and support items placed thereon. The stabilizing panel 10 may also be embodied as a firm or rigid object such as a shelf 10*b* (FIG. 7) that can provide a foundation and a planar surface on which to support the items. Thus, the expression 'stabilizing panel' should be construed broadly to encompass a mat and a shelf, but should not exclude other objects which are described as a pad, a cushion, a layer, a bed, a stratum, a tray, a receptacle, a board, a dish, a support or the like.

One example of the stabilizing panel is shown in FIG. 1 embodied as what may also be described as a mat 10*a*. The stabilizing panel 10 may be laid on any flat surface which may be inside an interior of an enclosed compartment that is also a temperature-controlled environment such as a refrigerator 100, a wine cellar, a freezer, or the like or in other storage areas. In this embodiment, the stabilizing panel 10 is substantially a rectangle in its entirety although other polygonal shapes are also contemplated. For example, the stabilizing panel 10 may have a parallelogram shape such as a square or be cross-shaped, L-shaped, frame-like, or otherwise. As shown in FIG. 1, the stabilizing panel 10 is configured with features that, as will be described below, enable the stabilizing panel 10 to stabilize, immobilize, firmly hold or otherwise support items with round surfaces, such as bottles or cans, so that the items do not roll or move in an undesired manner when laid down.

Figure 2B:
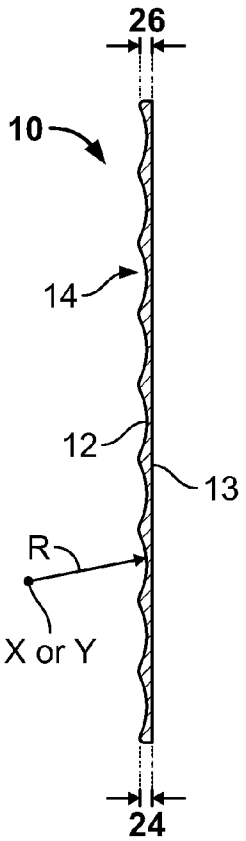
FIG. 2B is a profile view of a diagonal cross-section of the stabilizing panel.
Figure 2C:
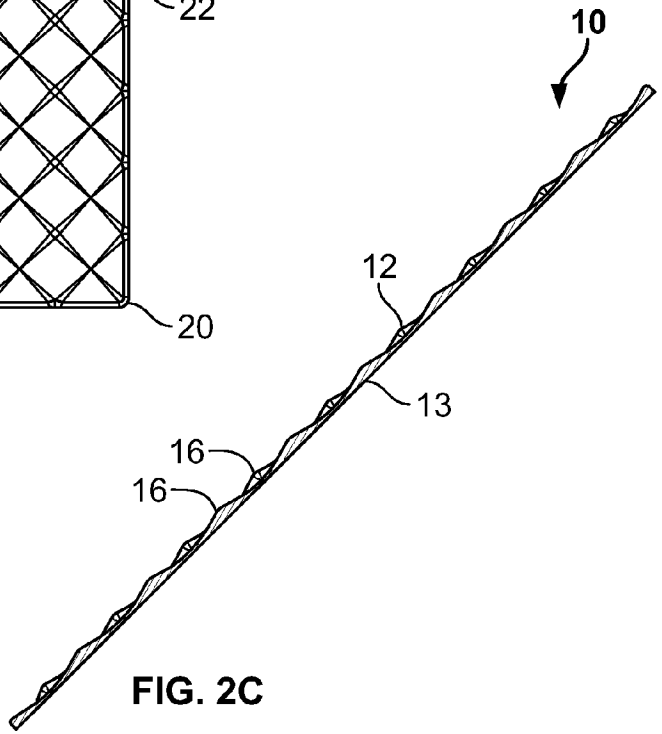
FIG. 2C is a profile view of a longitudinal cross-section of the stabilizing panel.
Figure 2A:
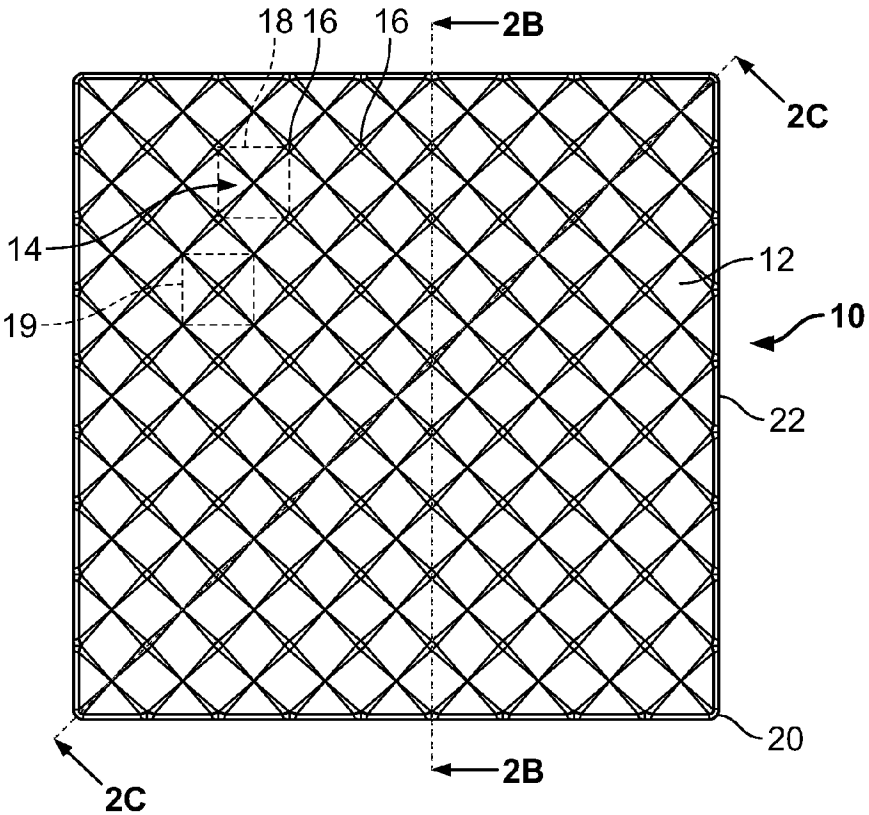
FIG. 2A is a top view of the stabilizing panel.

As shown in FIGS. 2A-2C, a first surface 12 of the stabilizing panel 10 includes a plurality of depressions 14 in which the aforementioned items can be placed and be substantially immobilized. The depressions 14 can be contrasted with a plurality of protruding peaks 16 which may be aligned longitudinally and transversely on the first surface 12 so that an orthogonal grid pattern would be formed if the peaks 16 were connected. However, other alternative arrangements of the peaks 16 are not excluded from contemplation. For example, the arrangement of the peaks 16 may form a grid in which the peaks 16 are aligned along or to be parallel with two orientations that are not perpendicular to one another. A single depression 14 may occupy a parallelogram area 18 on the first surface 12 such that the first surface 12 may be divisible into a plurality of equally sized, parallelogram areas 18 so that each parallelogram area 18 defines a single depression 14 as in FIG. 2A. Each parallelogram area 18 has four corners 20 and four edges 22, and each peak 16 is located at a corner 20 of a parallelogram area 18. It is not necessary for the entire first surface 12 to be divisible into a number of complete parallelogram areas 18. For example, the first surface 12 may be made up of complete and incomplete parallelogram areas 18.

It must be noted that, while the embodiment shown in FIG. 1 shows a square-shaped parallelogram area 18, the parallelogram area 18 may shaped as a parallelogram, a rhombus, a rectangle or the like in alternative embodiments of the stabilizing panel 10. In these embodiments with alternatively shaped parallelogram areas 18, the sides of the parallelogram areas 18, in which the opposing sides are parallel to one another, may define two orientations which the peaks 16 may be aligned to be parallel with. In other words, the arrangement of identically shaped, adjacent parallelogram areas 18 may be such that the sides become aligned.

As shown in FIG. 2B, the stabilizing panel 10 that is embodied as a mat 10*a* may also include a second surface 13 that is substantially flat without any protrusions. The corners 20 and the edges 22 of the first surface 12, regardless of the shape of the stabilizing panel 10, may each have a peak 16 so that, in case the stabilizing panel 10 is flipped upside down, the peaks 16 on the first surface 12 act as supporting structures so that the second surface 13 is kept flat and does not bend downward at the edges 22.

Figure 6:
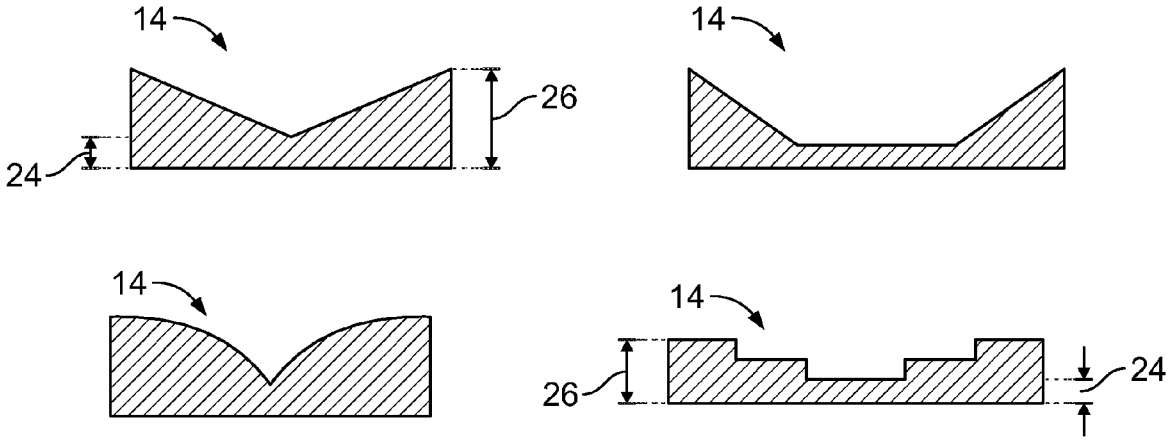
FIG. 6 is an illustration of the depression with alternative cross-sectional shapes.

As shown in FIGS. 2B and 6, the first surface 12 may range from a first elevation 24, where the first surface 12 may be at its lowest, to a second elevation 26 that is higher than the first elevation 24 and to which the peaks 16 may rise. It is also contemplated that the first surface 12 may include one or more additional elevations that are different from the first elevation 24 and the second elevation 26 and the range of elevation may differ in one part of the first surface 12 compared to another part of the first surface 12.

Figure 4A:
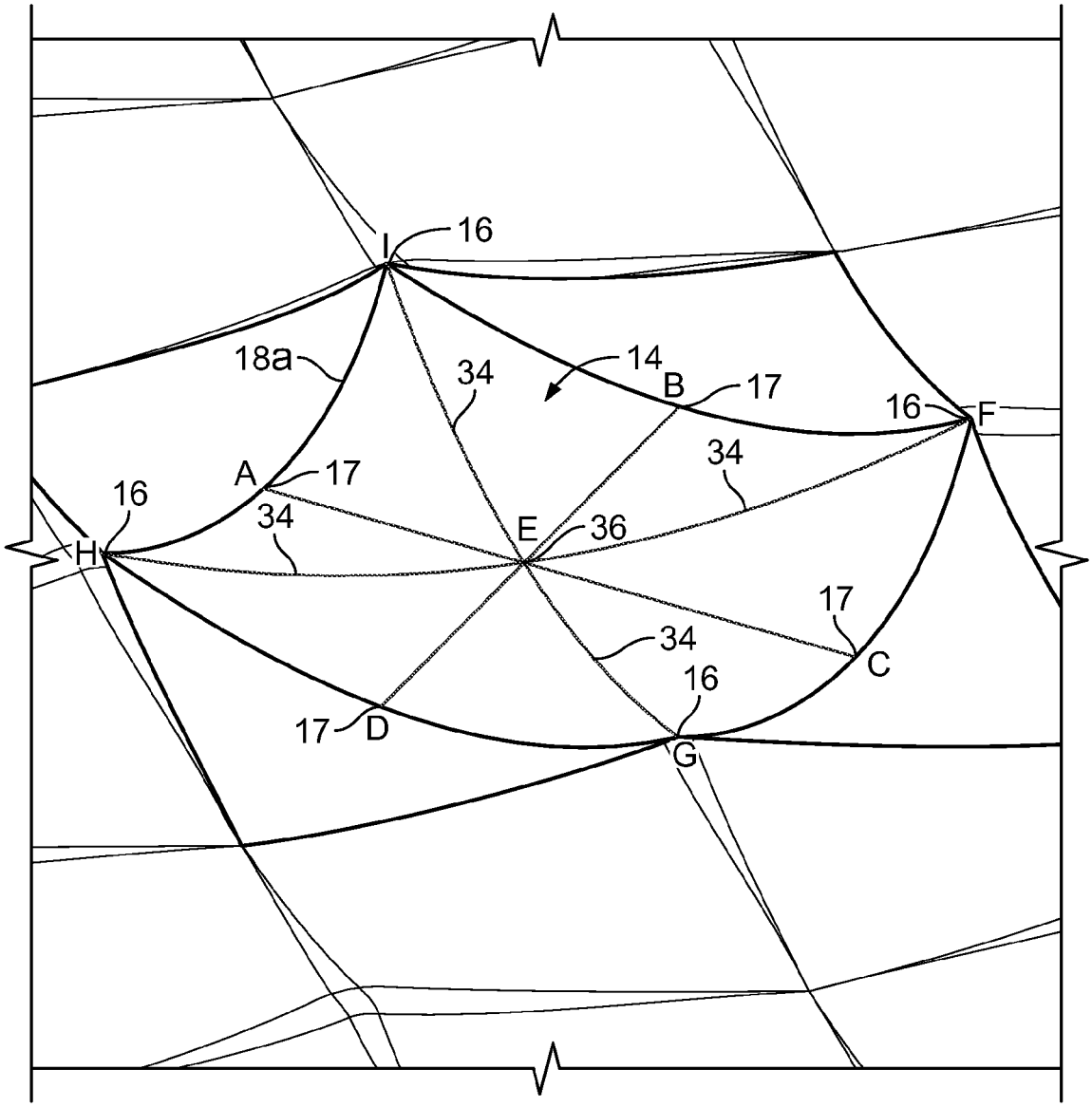
FIG. 4A is a close-up view of a squared area of the stabilizing panel with a depression and peaks.

In this embodiment, the midpoint of two longitudinally or transversely closest peaks 16 is at the first elevation 24, and the midpoint 17 of two closest peaks 16 is also at the first elevation 24 while the peaks 16 are at the second elevation 26 as shown in FIG. 4A. In other words, points A, B, C, D (midpoints) and E (center of depression) are at the first elevation 24 while points F, G, H, and I (peaks) are at the second elevation 26.

Figure 3:
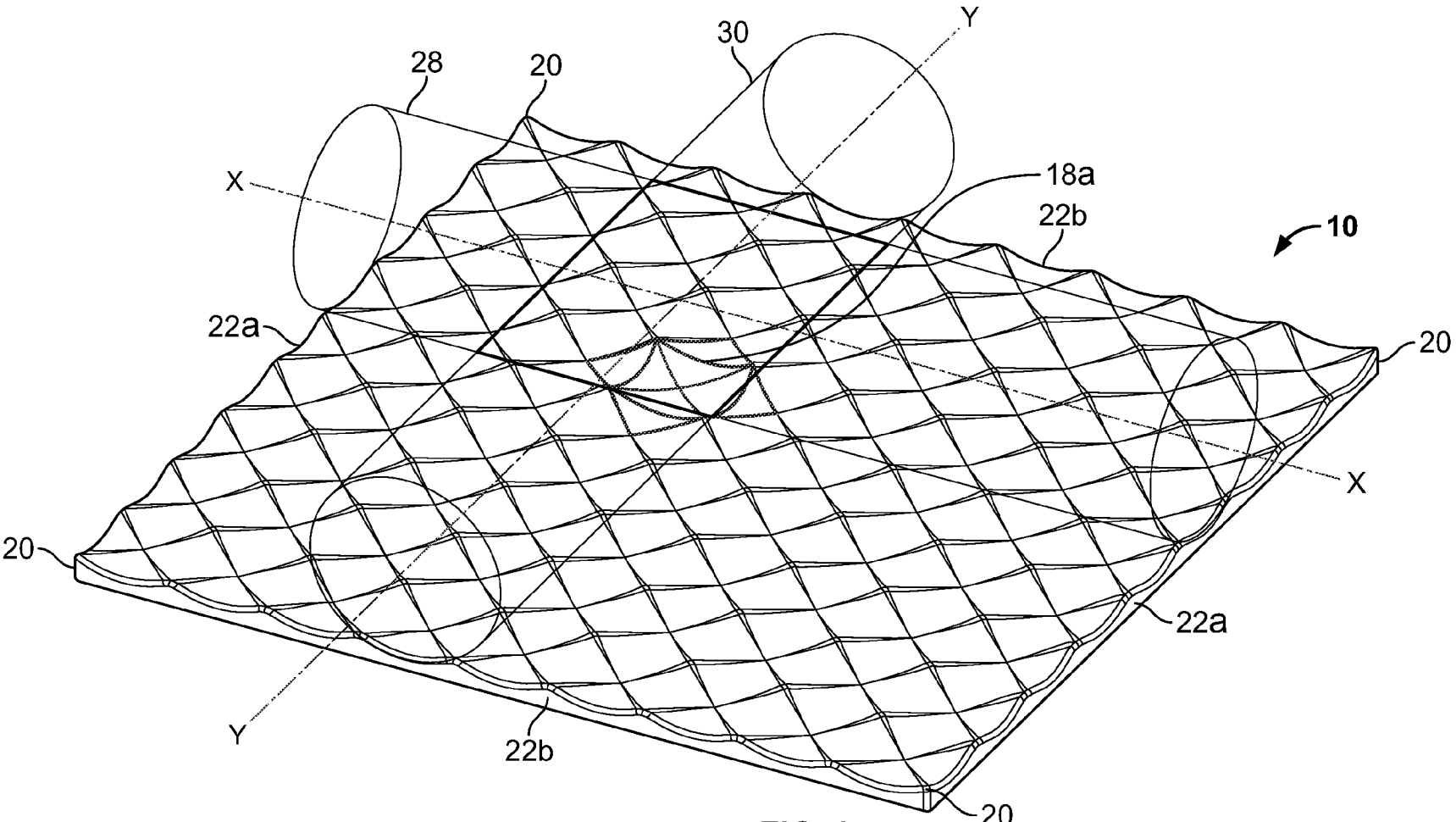
FIG. 3 is a perspective view of the stabilizing panel.

The geometry of the depression 14 can be explained as follows and shown in FIGS. 2B and 3. In each parallelogram area 18, one depression 14 has a constant radius of curvature R of about 1.3 inches with respect to a first axis X that is located above the first surface 12. At the same time, one depression 14 also has a constant radius of curvature R of about 1.3 inches about a second axis Y that is also located above the first surface but is perpendicular to the first axis X. This is illustrated in FIG. 3 which shows two cylinders 28, 30 whose radii have the same value R and whose axes X, Y intersect perpendicularly. As shown in FIG. 3, the first axis X may be parallel to the longitudinal edges 22*a* of the stabilizing panel 10 while the second axis Y may be parallel to the transverse edges 22*b* of the stabilizing panel 10. The resulting parallelogram area 18*a* near the intersection of the two cylinders 28, 30 will have a depression 14 with the same radius of curvature R about axis X and about axis Y. The depression 14 includes ridges 34 that are diagonally oriented and are formed as the peaks 16 at the second elevation 26 gradually transitions to the center 36 of the depression 14 that is at the first elevation 24. Each parallelogram area 18 of the first surface 12 may have a depression 14 with identical geometry. The same radii of curvature enable an item to be stabilized in the same manner whether the item is placed along two different orientations, which may be longitudinal and transversal for example, on the stabilizing panel 10.

However, in alternative embodiments of the stabilizing panel 10, the geometry of the first surface 12 may vary and have different or no curvatures, different elevations, or the like.

Figure 4B:
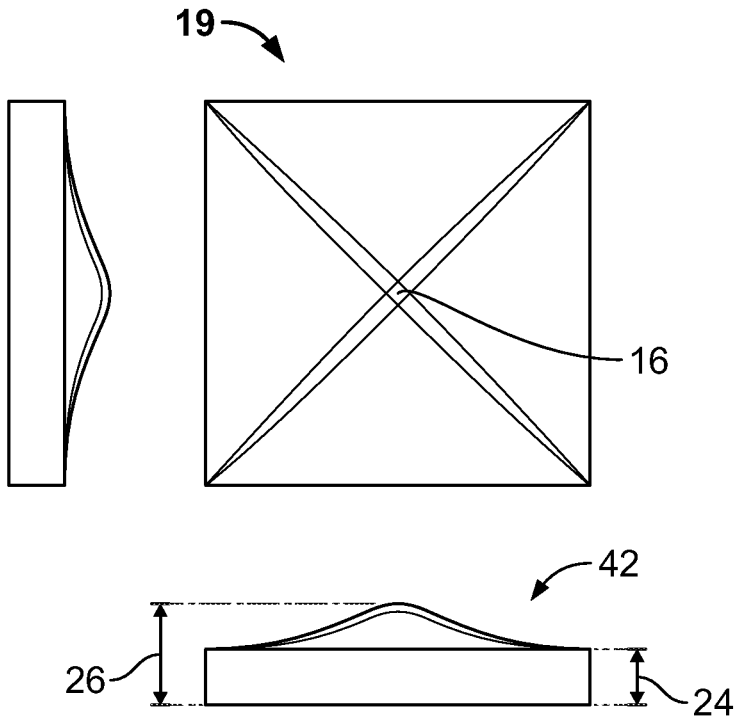
FIG. 4B are top and side views of an alternative squared area shown in an isolated state.
Figure 4C:
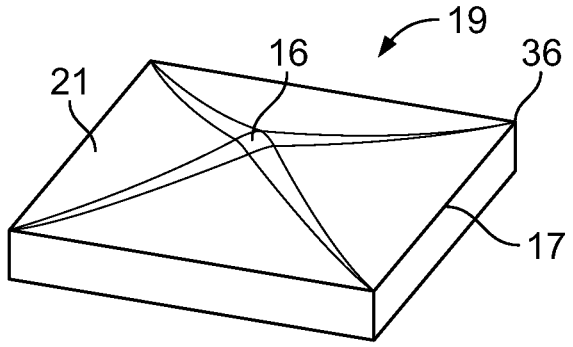
FIG. 4C is a perspective view of the alternative squared area shown in an isolated state.

The same geometry of the first surface 12 can also be described by dividing the first surface 12 into alternatively selected parallelogram areas 19 shown in FIG. 2A. FIGS. 4B and 4C show the alternatively selected parallelogram area 19 detached from the stabilizing panel 10 and including only a single peak 16. The alternative parallelogram area 19 may include a substantially pyramidal or diamond configuration formed by four substantially triangular surfaces 21. The four triangular surfaces 21 may be concave as shown in FIG. 4B and each have a radius of curvature of R as discussed above. Thus, the peak 16 is defined by a tip of a substantially pyramid or diamond protrusion 42. The four triangular surfaces 21 meet to form the peak 16. The center 36 of depression 14 and the midpoint 17 of two closest peaks 16 are also indicated in FIG. 4C. Under the above dimensions, the distance between two closest peaks 16 are 1.38 inches.

Figure 5:
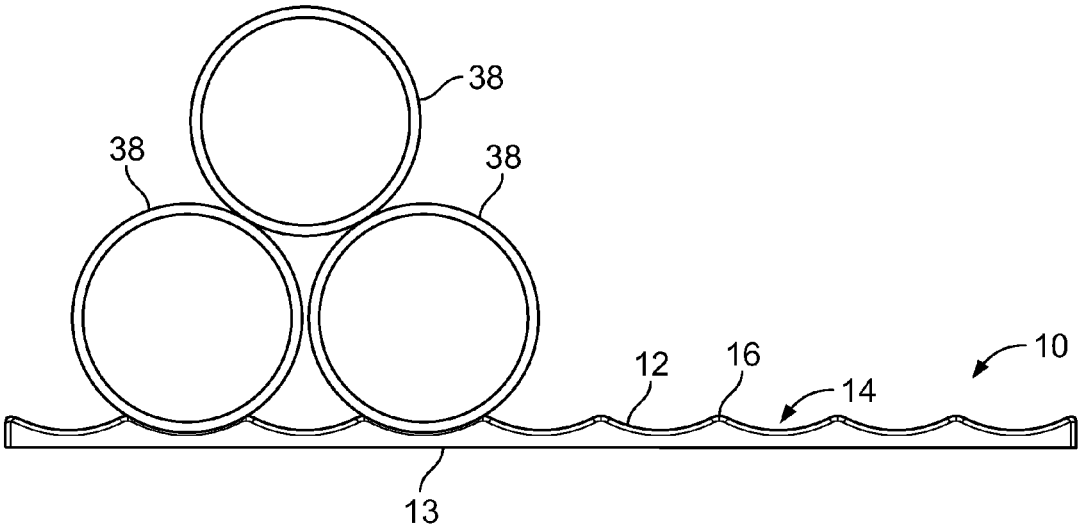
FIG. 5 is a side profile view of the stabilizing panel with items placed on a first surface.

The radius of curvature R of the depression 14 and the distance between peaks 16 are likely to be affected by the types of items 38 that are placed on the stabilizing panel 10. For example, if the contour of the item 38 is closely matched by the geometry of the depression 14, the degree of stability is likely to be higher. Moreover, as shown in FIG. 5, the dimensions of the depression 14 may also be adjusted so that two items 38, which are placed on the first surface 12 adjacent one another but separated by a depression 14, are kept apart but are sufficiently close so that an additional item 38 may be stacked above an in between the two items 38. If the round surface of the item 38 has a different radius of curvature, adjusting the radius of curvature of the depression to match this curvature may result in a more accommodating or versatile stabilizing panel 10. As mentioned above, it may be possible to have a stabilizing panel 10 in which different parts of the first surface 12 have different radii of curvature.

The resulting stability may also be affected by the material of which the stabilizing panel 10 is made. For example, the stabilizing panel 10 may be made of elastomers such as rubber that are likely to create a high coefficient of friction and improve stability for items placed on the stabilizing panel 10. However, the stabilizing panel 10 may also be made of material such as polymers which may simply offer the benefits arising from geometry but not the frictional benefits.

Although in the shown embodiment the first surface 12 transitions from the minimum elevation 24 to the maximum elevation 26 through concave surfaces, the depressions 14 in the parallelogram areas 18 may also be formed from other types of surfaces that are flat, angled, convex, stepped or otherwise. For example, the depressions 14 may be formed such that the depressions 14 have cross-sectional views shown in FIG. 6. The maximum elevation 26 need not be a point but may also be a line or a plane.

Figure 7:
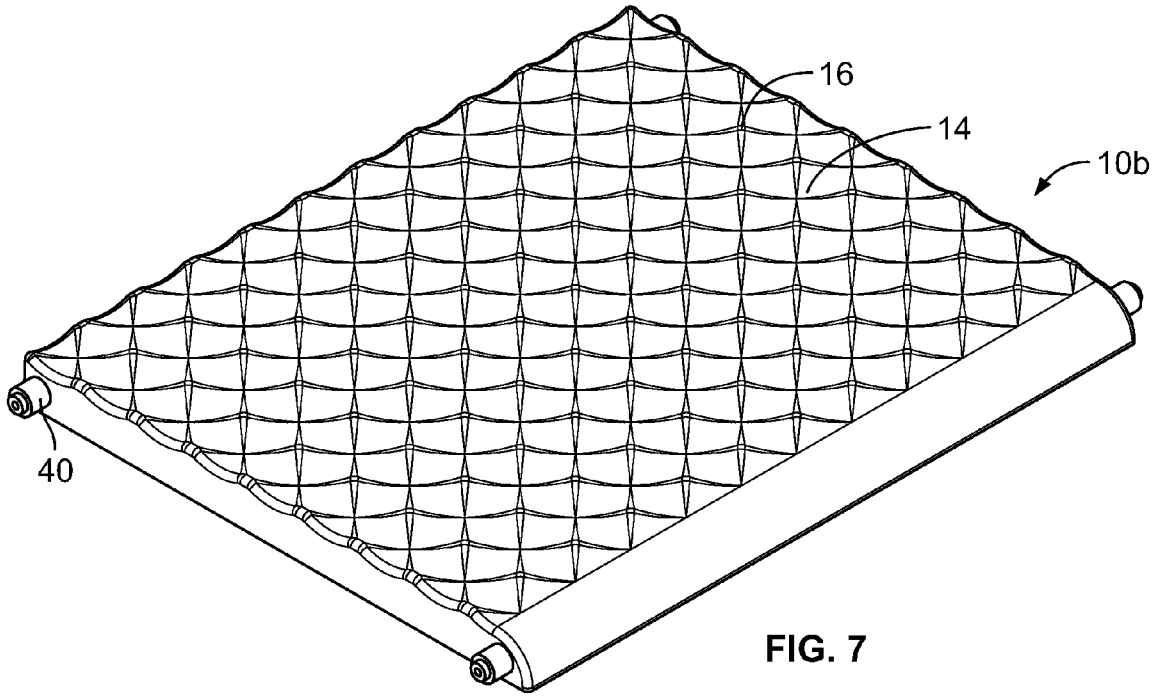
FIG. 7 is a view of a second example embodiment of the stabilizing panel.

It is possible to form a stabilizing panel 10 in other types of embodiments such as a shelf 10*b* that is part of a cabinet structure such as a refrigerator 100. FIG. 7 shows a second embodiment in which a top surface of the shelf is configured with peaks 16 and depressions 14. The peaks 16 and depressions 14 may be molded integrally to the shelf 10*b* or can be formed by a separate piece that is glued to the shelf 10*b*. The shelf 10*b* may be attachable and detachable from the cabinet structure through pins 40 that are received by receptacles inside the cabinet structure. This embodiment may be mounted upside down so as to provide a second surface as well.

Figure 8A:
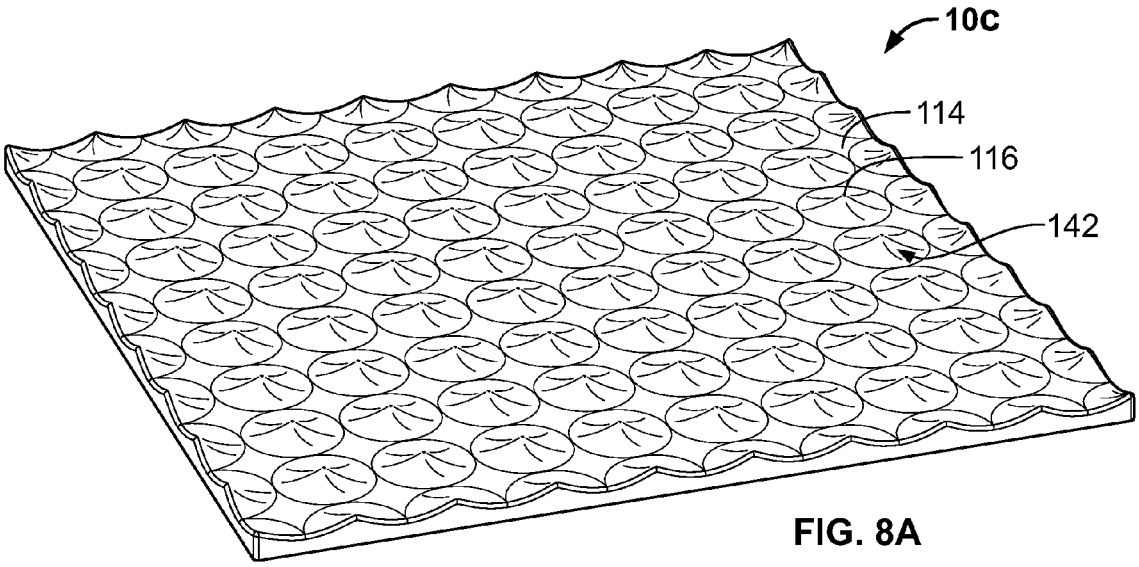
FIG. 8A is a perspective view of a third embodiment of the stabilizing panel.
Figure 8B:
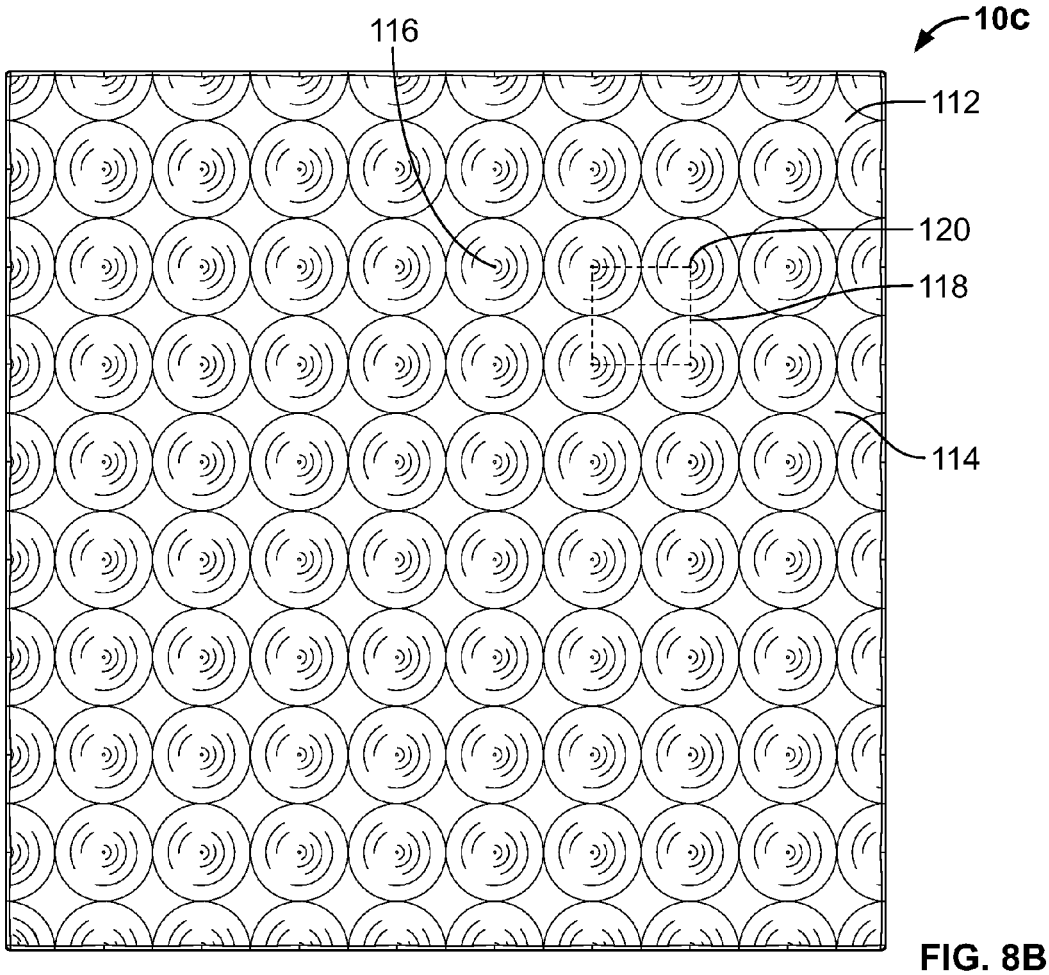
FIG. 8B is a top view of the third embodiment of the stabilizing panel.

Referring to FIGS. 8A-8B, a third embodiment of the stabilizing panel 10*c* is shown. In this embodiment, the first surface 112 can be divided into a plurality of parallelogram areas 118, where a peak 116 is located at each corner 120 of the parallelogram area 118 and in which a depression 114 is formed, similarly to the first embodiment. In contrast with the first embodiment, the first surface 112 of the third embodiment includes substantially cone-shaped protrusions 142. The protrusions 142 are shaped such that an outer surface joining the tip or peak 116 and the base are concave.

Figure 9A:
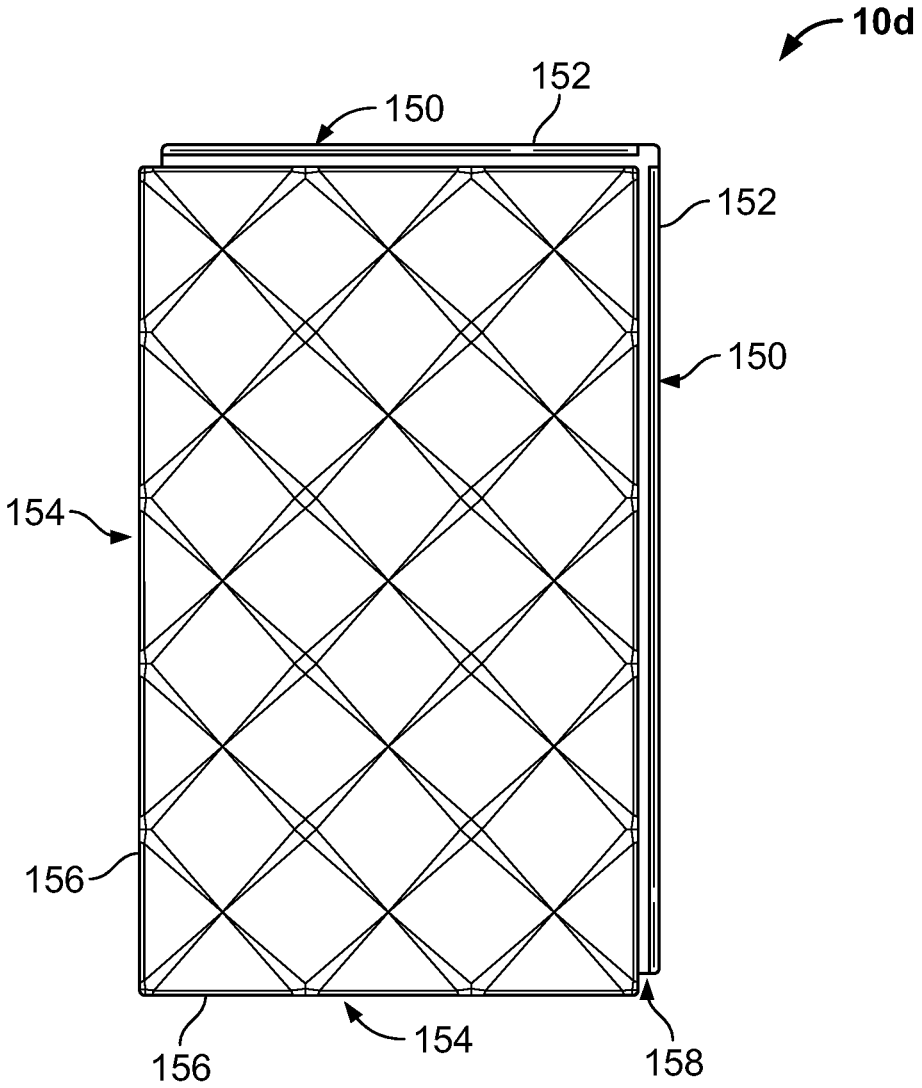
FIG. 9A is a top view of a fourth embodiment of the stabilizing panel with male connecting sections and female connecting sections.
Figure 9B:
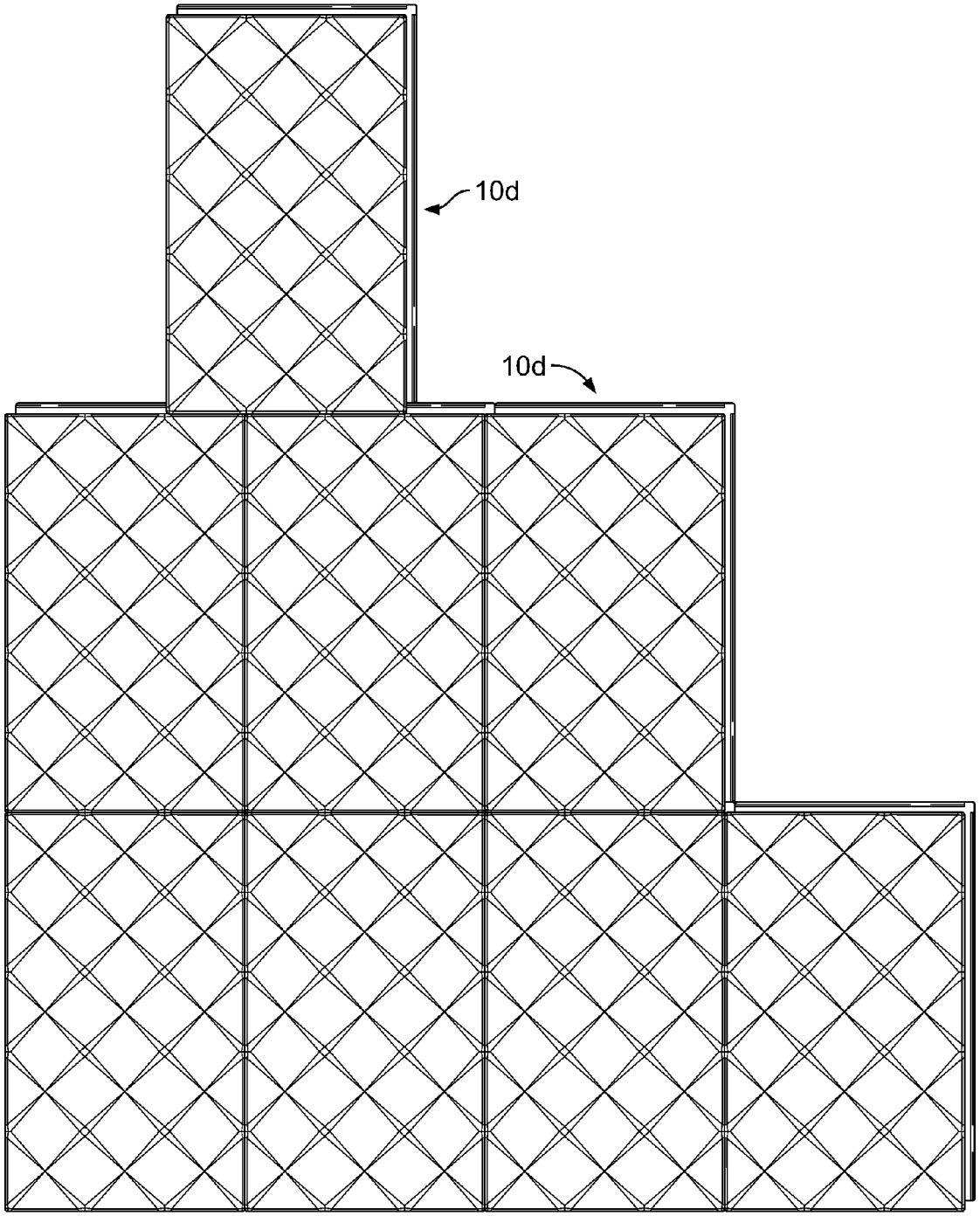
FIG. 9B is a top view of a plurality of stabilizing panels joined by the male connecting sections and the female connecting sections.
Figure 9C:
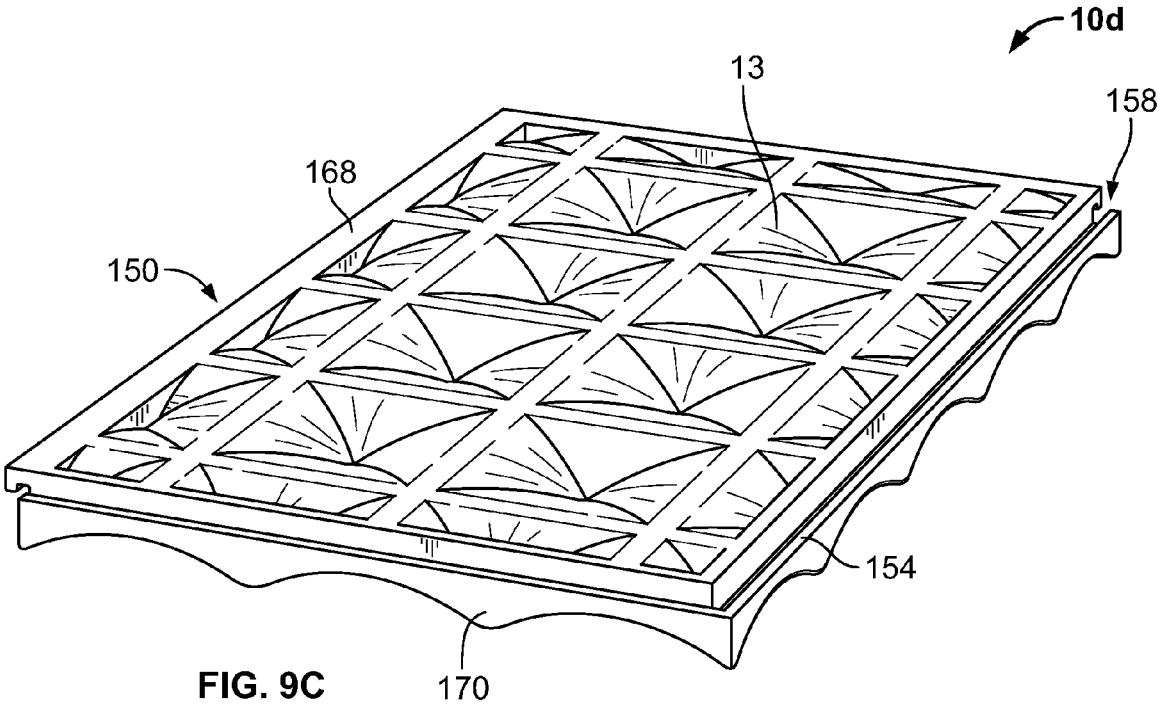
FIG. 9C is a perspective view of a second surface of the fourth embodiment of the stabilizing panel with a bottom layer and a top layer.

Referring to FIG. 9A, a fourth embodiment of stabilizing panel 10*d* configured with features for securing together two or more stabilizing panels 10*d* (FIG. 9B) is shown. FIG. 9C shows the bottom of the stabilizing panel 10*d* on which male connecting sections 150 and female connecting sections 154 are formed with discontinuous sections 158. The stabilizing panel 10*d* may be described as having a two-layer periphery wherein a bottom layer 168 is offset about a top layer 170 in a diagonal or angled direction such that the edges of the bottom layer 168 become offset from the neighboring edges of the top layer 170.

The two-layer structure forms, on the stabilizing panel 10*d*, a male connecting section 150 extending substantially along each of a pair of adjacent first edges 152 and with a female connecting section 154 extending substantially along each of a pair of adjacent second edges 156. In this embodiment, the male connecting section 150 projects outwardly from each first edge 152 so as to form an L-shape while the female connecting section 154 is formed on the second surface 13 in an L-shape configuration. The second surface 13 may be flat or engraved as shown in FIG. 9C.

Figure 9D:
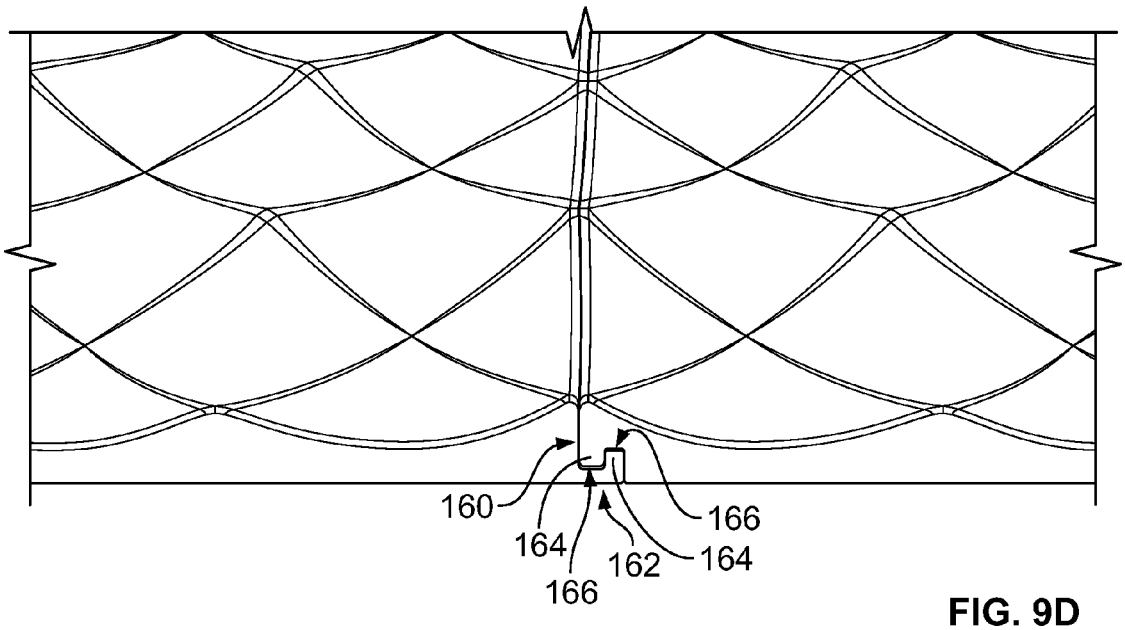
FIG. 9D is a close-up view of a boundary of two stabilizing panels.

As shown in FIG. 9D, the boundary of two neighboring stabilizing panels 10*d* is shown. A male connecting element 160 is formed on the male connecting section 150 while a female connecting element 162 is formed on the female connecting section 154. The male connecting element 160 and the female connecting element 162 may each include a tongue portion 164 that is vertically oriented and a groove portion 166 in which the tongue portion 164 of the other connecting element can be accommodated. The male connecting element 160 and the female connecting element 162 are shaped such that neighboring stabilizing panels 10*d* can interlock along the edges as shown in FIG. 9D.

The male connecting section 150 may be identical in length to the corresponding first edge 152 except that the male connecting section 150 is offset. As a result, the male connecting section 150 does not extend fully along the first edge 152 and the first edge 152 may include a discontinuous section 158. As shown in FIG. 9B, the discontinuous section 158 allows the stabilizing panels 10*d* to be placed next to one another without the male connecting section 150 of one stabilizing panel 10*d* overlying the male connecting section 150 of another stabilizing panel.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A refrigerator, comprising a shelf, comprising a first surface and a second surface, the first surface forming a first side of the shelf and configured to inhibit movement of items placed thereon, the first surface comprising an elastomer, the first surface including a plurality of parallelogram areas including four corners and four sides, each corner of the parallelogram areas including a peak, the peaks aligned so as to be parallel with one of the four sides of the parallelogram areas on the first surface, a plurality of depressions in the first surface, each of the parallelogram areas defining one of the plurality of depressions at the center of the parallelogram area, the second surface forming a second side of the shelf facing a direction that is opposite from a direction that the first side of the shelf faces and having an area that corresponds with an area of the first surface, the second surface being flat.

2. The refrigerator of claim 1, wherein a center of each of the parallelogram areas is at a first elevation, the peaks are at a second elevation, and the second elevation is greater than the first elevation.

3. The refrigerator of claim 2, wherein the depression is shaped such that the first surface gradually transitions from the first elevation to the second elevation.

4. The refrigerator of claim 3, wherein the depression includes concave surfaces such that the depression has a first radius of curvature about a first axis and a second radius of curvature about a second axis, the first axis and the second axis intersecting one another.

5. The refrigerator of claim 4, wherein the four sides of parallelogram areas include a first set of parallel sides and a second set of parallel sides, and the first axis is parallel to the first set of parallel sides and the second axis is parallel to the second set of parallel sides.

6. The refrigerator of claim 4, wherein the first radius of curvature and the second radius of curvature are the same.

7. The refrigerator of claim 3, wherein the peak is a tip of a substantially cone-shaped protrusion.

8. The refrigerator of claim 3, wherein the peak is a tip of a substantially pyramid-shaped protrusion.

9. The refrigerator of claim 1, wherein the entire first surface is divisible into a plurality of complete parallelogram areas.

10. The refrigerator of claim 1, wherein each parallelogram area is arranged such that at least one of the four sides of one of the parallelogram areas is bounded by one of the four sides of another of the parallelogram areas.

11. The refrigerator of claim 1, wherein all of the parallelogram areas include only one depression and are equal in size.

12. The refrigerator of claim 1, wherein the elastomer is composed of rubber.

13. The refrigerator of claim 1, wherein the first surface is slip resistant.

14. The refrigerator of claim 1, wherein the shelf is rectangular and each corner of the shelf includes a peak, and at least a peak, other than the peaks at the corners, is arranged along each edge of the shelf.

15. The refrigerator of claim 1, wherein the shelf is configured as a mat.

16. The refrigerator of claim 1, wherein the parallelogram areas are squared areas.

17. The refrigerator of claim 1, wherein the first surface is composed of the elastomer.

18. A refrigerator, comprising a shelf, comprising a flexible elastomer, comprising a first surface having an elevation that varies throughout and a second substantially flat surface facing a direction opposite the first surface, the first surface including a plurality of parallelogram areas and pluralities of corners and edges surrounding the plurality of parallelogram areas, outermost edges of the corners and the edges defining an outermost edge of the shelf, each parallelogram area including a substantially diamond configuration defined by four triangular surfaces meeting at a peak, each of the corners having one or more peaks at the outermost edge thereof, each of the edges having a plurality of peaks at the outermost edge thereof, the first surface being configured to inhibit movement of items placed thereon.

19. The refrigerator of claim 18, wherein the triangular surfaces are concave and have equal radii of curvature.

20. The refrigerator of claim 18, wherein the peaks are aligned transversely and longitudinally in an orthogonal grid pattern on the first surface.

21. A refrigerator, comprising:

a shelf, comprising a first surface and a second surface, the first surface being flat and constituting an area of an entirety of the shelf, the second surface being configured to support and inhibit movement of items placed thereon, the second surface comprises an elastomer, the second surface being formed on an entirety of the first surface, the second surface comprising a plurality of parallelogram areas, a plurality of depressions in the second surface, each of the parallelogram areas comprising four corners and four sides and defining one of the plurality of depressions at the center of each parallelogram area, each of the corners comprising a peak, the peaks of the corners being aligned to be parallel with one of the four sides.

22. The refrigerator of claim 21, wherein an area of the second surface corresponds to an area of the first surface.

* * * * *